US006709133B2

(12) United States Patent
Lin et al.

(10) Patent No.: US 6,709,133 B2
(45) Date of Patent: Mar. 23, 2004

(54) ANTI-SLIP FLUORESCENT ELECTRONIC ENERGY-SAVING LAMP

(75) Inventors: Wei-xiong Lin, Shunde (CN); Jian-xiong Peng, Shunde (CN)

(73) Assignee: Guangdong Weixiong Group Co., Ltd., Shunde (CN)

( * ) Notice: Subject to any disclaimer, the term of this patent is extended or adjusted under 35 U.S.C. 154(b) by 0 days.

(21) Appl. No.: 10/150,011

(22) Filed: May 16, 2002

(65) Prior Publication Data

US 2003/0117801 A1 Jun. 26, 2003

(30) Foreign Application Priority Data

Jun. 17, 2001 (CN) ..... 01242268 U

(51) Int. Cl.[7] ..... F21K 2/00; F21V 17/06

(52) U.S. Cl. ..... 362/260; 362/216; 362/389; 362/448

(58) Field of Search ..... 362/216–225, 362/255, 256, 260, 389, 443, 448; 313/318.01, 318.09, 318.1, 318.11

(56) References Cited

U.S. PATENT DOCUMENTS 4,278,911 A * 7/1981 Metoff ..... 313/318.09
4,723,200 A * 2/1988 Troen ..... 362/260
4,787,018 A * 11/1988 Poyer ..... 362/216
4,878,159 A * 10/1989 Blaisdell et al. ..... 362/222
5,436,815 A * 7/1995 Grooms et al. ..... 362/216
5,971,564 A * 10/1999 Wang ..... 362/216

FOREIGN PATENT DOCUMENTS

| | | | |
|---|---|---|---|
| CN | 2220683 | 2/1996 | |
| CN | 2253798 | 5/1997 | |
| CN | 2454901 | 10/2001 | |
| JP | 403246805 A * | 11/1991 | ..... 362/216 |

* cited by examiner

*Primary Examiner*—Alan Cariaso
(74) *Attorney, Agent, or Firm*—Intellectual Property Law Group LLP; Otto O. Lee; Juneko Jackson

(57) ABSTRACT

An anti-slip fluorescent electronic energy-saving lamp comprises a fluorescent tube or bulb and a lamp cabinet within which the electronic parts are installed. The outer shell of the lamp cabinet is of a surface of revolution, on which an anti-slip ring is mounted. The anti-slip ring is made of anti-slip materials and the ring sectional plane of the anti-slip ring is in parallel with the circular sectional plane of the outer shell of the lamp cabinet. Thanks to the anti-slip ring mounted outside the outer shell of the lamp cabinet, the fluorescent electronic energy-saving lamp of the present invention is easy to grasp and will not be easily to fall to the ground and break into pieces in installation and usage. Since the anti-slip ring is made of rubber or plastic, it can be made into various colors, which is helpful for identification and decoration.

6 Claims, 4 Drawing Sheets

ANTI-SLIP FLUORESCENT ELECTRONIC ENERGY-SAVING LAMP

BACKGROUND OF THE INVENTION

1. Field of the Invention

The present invention relates to a lighting apparatus, and more particularly, to a fluorescent electronic energy-saving lamp.

2. Description of Related Art

The fluorescent electronic energy-saving lamp is a kind of lighting apparatus which has a fluorescent tube or bulb as the luminous body. It is popular in the home and abroad in virtue of its many advantages such as saving energy and environment protection. The conventional fluorescent electronic energy-saving lamp comprises a fluorescent tube and a lamp cabinet in which are located electronic parts. It may further comprise a lamp base which functions to protect the lamp cabinet, and a glass cover or a lamp shade which functions to protect the fluorescent tube. Traditionally, the lamp tube is made of glass, and the lamp cabinet is made of metal. Since both of these materials are slippery, the conventional fluorescent electronic energy-saving lamp easily falls to the ground and break into pieces when one tries to grasp it in hand. Furthermore, the appearance of the lamp in the prior art is monotonic in color, it is either grey or white, looks awkward and dull.

SUMMARY OF THE INVENTION

The aim of this invention is to overcome the shortcomings of the prior art mentioned above, and provide an anti-slip fluorescent electronic energy-saving lamp which is easy to grasp in the hand tightly. The anti-slip fluorescent electronic energy-saving lamp of the present invention comprises a fluorescent tube and a lamp cabinet within which the electronic parts are installed. The outer shell of the lamp cabinet has a surface of revolution, on which an anti-slip ring is mounted. The anti-slip ring is made of anti-slip materials and the ring sectional plane of the anti-slip ring is in parallel with the circular sectional plane of the outer shell of the lamp cabinet.

Another aim of this invention is to provide a fluorescent electronic energy-saving lamp which has a colorful appearance.

In a preferred embodiment of the present invention, the anti-slip ring is made of rubber or plastic.

Due to the anti-slip ring being mounted outside the outer shell of the lamp cabinet, the fluorescent electronic energy-saving lamp of the present invention is easy to grasp and will not easily fall to the ground and break into pieces during installation and usage. Since the anti-slip ring is made of rubber or plastic, it can be made into various colors which is helpful for identification and decoration.

BRIEF DESCRIPTION OF THE DRAWINGS

Features, aspects and advantages of some embodiments of the present invention will become better understood with reference to the accompanying drawings, which are not to be considered limitations in the scope of the invention, but are merely illustrative.

DETAILED DESCRIPTION OF SPECIFIC EMBODIMENTS

The description above and below and the drawings of the present document discuss one or more currently preferred embodiment(s) and also describe some exemplary optional feature(s) and alternative embodiment(s). The description and drawings are for the purpose of illustration and not limitation. Section titles are terse and are for convenience and not limitation.

Figure 1:
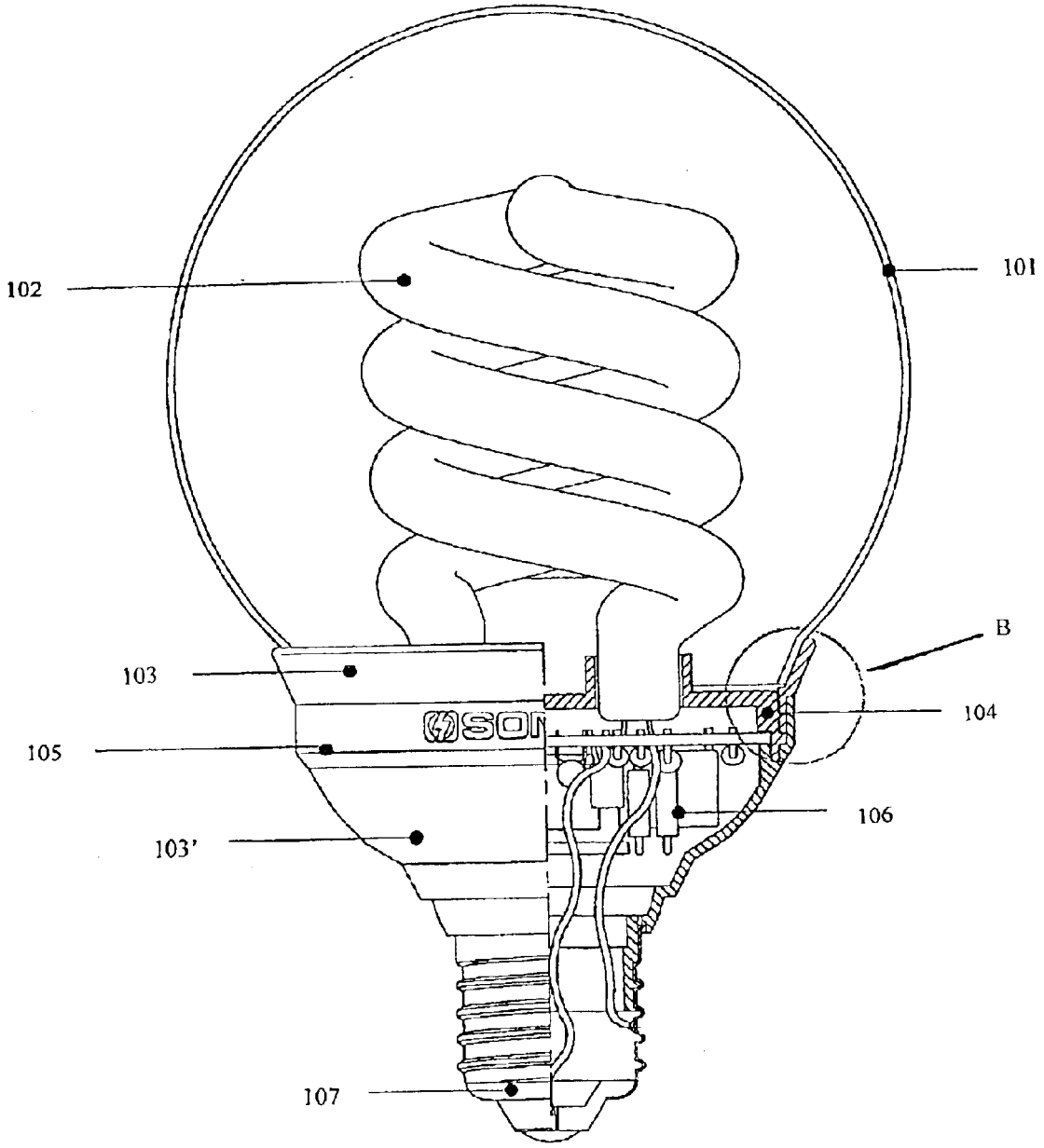
FIG. 1 is a schematic view of a preferred embodiment of an anti-slip fluorescent electronic energy-saving lamp of the present invention.
Figure 2:
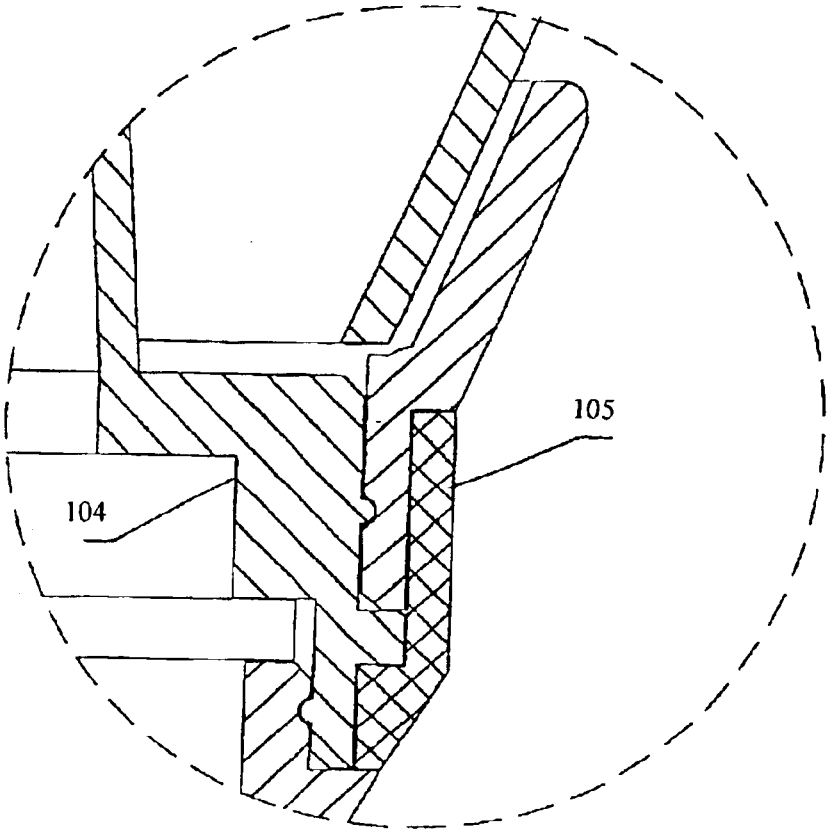
FIG. 2 is an enlarged view of the part B of the anti-slip fluorescent electronic energy-saving lamp shown in FIG. 1.
Figure 3:
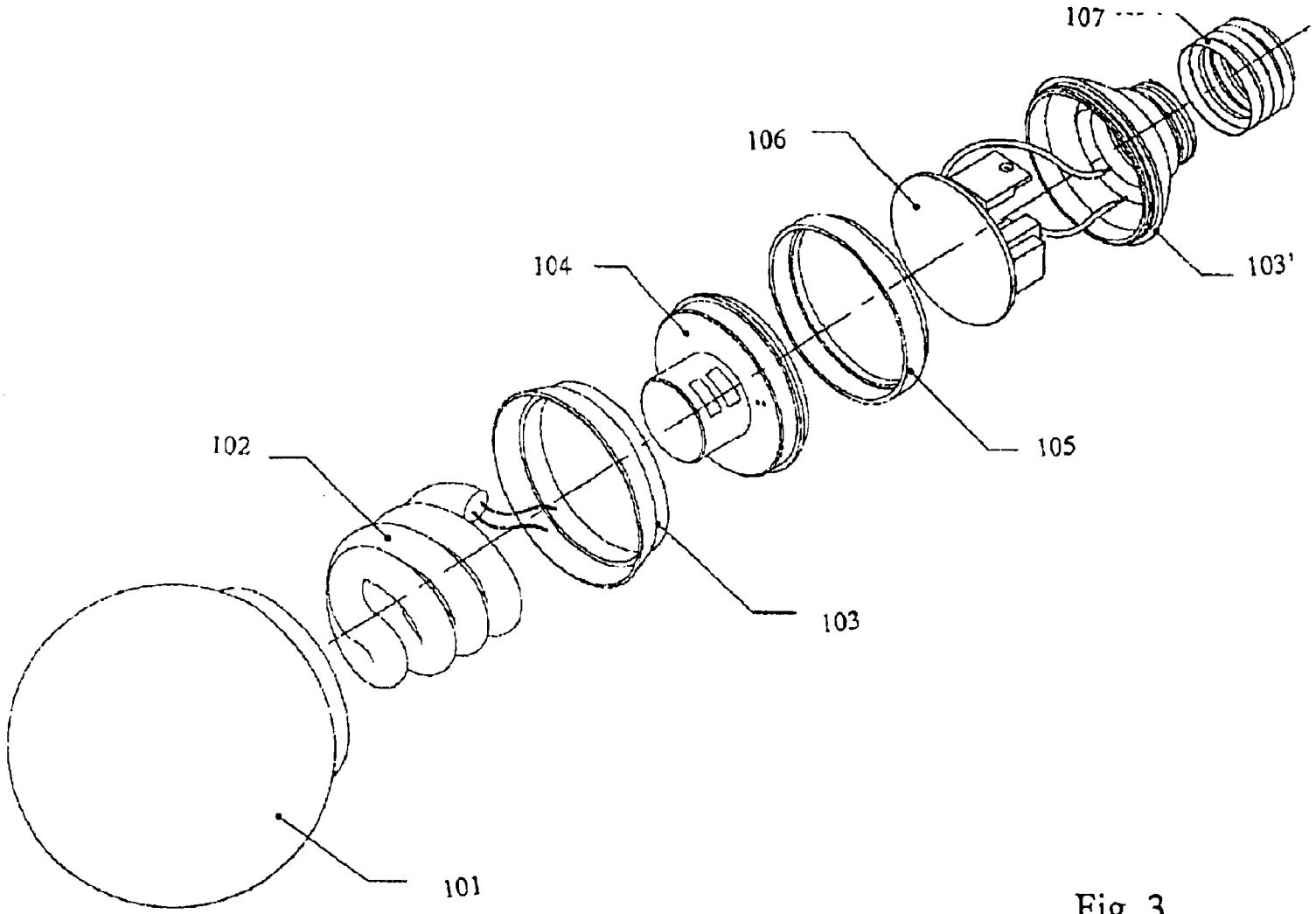
FIG. 3 is a resolved schematic view of the anti-slip fluorescent electronic energy-saving lamp shown in FIG. 1.

Referring to FIGS. 1, 2 and 3, in one preferred embodiment of the present invention, the anti-slip fluorescent electronic energy-saving lamp comprises a glass cover 101; a fluorescent tube or bulb 102; tube holder 104: anti-slip ring 105; electronic parts 106; a lamp cabinet having a top lamp cabinet 103 and a bottom lamp cabinet 103'; and a lamp bottom 107. The electronic parts 106 are installed inside the bottom lamp cabinet 103', the tube 102 is fixed by the tube holder 104, and the tube 102 is electrically connected with the electronic parts 106. On the bottom of the tube holder 104 there are internal screws, matching with the external screws on the top of the bottom lamp cabinet 103', and the tube holder 104 and the bottom lamp cabinet 103' are joined together through the screws. On the tube holder 104 there are external screws, matching with the internal screws on the bottom of the top lamp cabinet 103, and the tube holder 104 and the top lamp cabinet 103 are joined together through the screws. The anti-slip ring 105 is ring-shaped, and on the top lamp cabinet 103 there is a groove for receiving the anti-slip ring 105.

Figure 4:
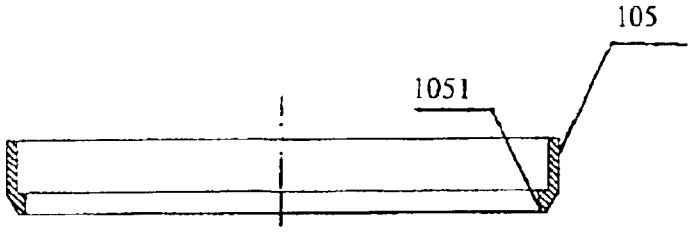
FIG. 4 is the sectional view of anti-slip ring of the anti-slip fluorescent electronic energy-saving lamp shown in FIG. 1.

As shown in FIG. 4, the bottom end 1051 of the anti-slip ring 105 is protruding inwards and blocked within the groove of the top lamp cabinet 103, so as to make the outer surface plain. The anti-slip ring 105 is made of anti-slip material, such as rubber or plastic, etc. The glass cover 101 is mounted on the top lamp cabinet 103 to protect the fluorescent tube 102. Since the anti-slip ring 105 is made of rubber or plastic, it can be held firmly in hand, and the lamp will not easily fall to the ground and break into pieces in installation and usage. In addition, the anti-slip ring can be made into various colors, and have decorative effects.

Figure 5:
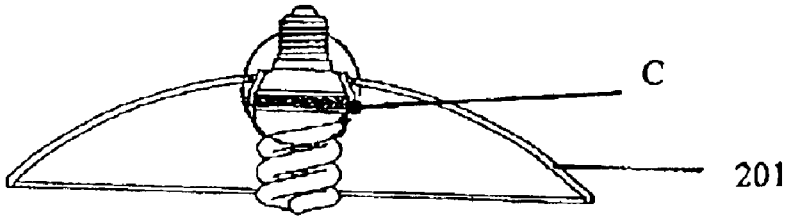
FIG. 5 is a schematic view of another preferred embodiment of an anti-slip fluorescent electronic energy-saving lamp of the present invention.
Figure 6:
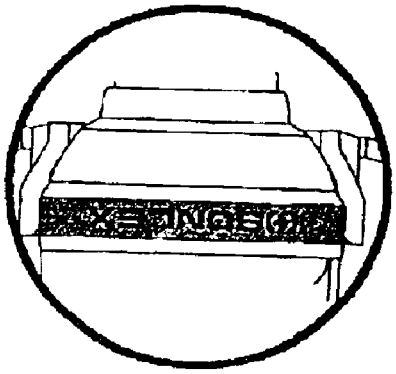
FIG. 6 is an enlarged view of the part C of the anti-slip fluorescent electronic energy-saving lamp shown in FIG. 5.

Referring to FIGS. 5 and 6, in another preferred embodiment of the present invention, there is no glass cover outside the lamp tube 102, and the lamp cabinet is an integrated entity, on which there is a groove to receive the anti-slip ring. The anti-slip ring is tube-shaped, and installed inside the groove on the lamp cabinet. On the lamp cabinet, there is installed a lamp shade 201, which has a base on its top, matching with the lamp cabinet. The lamp shade 201 is mounted outside the anti-slip ring, to avoid damage to the lamp cabinet due to the direct contact with the lamp cabinet. Since the frictional coefficient of the anti-slip ring is relatively bigger, a relatively bigger silent frictional force will generate between the anti-slip ring and the lamp shade 201, so as to help the lamp shade 201 be firmly fixed on the lamp cabinet. In this embodiment, an anti-slip ring of specific color is used for an energy-saving lamp of a different power, therefore, the anti-slip ring can also be useful for identifying different products embodying the invention.

The scope of the invention is not limited merely to the specific example embodiments or configurations of the foregoing description, but rather is indicated by the appended claims. All changes that come within the meaning and range of equivalents within the claims are intended to be understood as being embraced within the scope of the claims.

What is claimed is:

1. An anti-slip fluorescent electronic energy-saving lamp comprising:

a fluorescent tube;

a lamp cabinet within which a plurality of electronic parts are installed, the lamp cabinet having an outer surface, wherein the outer surface is an integral entity of a surface of revolution; and an anti-slip ring that is tube-shaped and made of a rubber or a plastic, the anti-slip ring being inlaid around the outer surface of the lamp cabinet, the outer surface of the lamp cabinet having a groove for receiving the anti-slip ring, the anti-slip ring being housed within the groove of the lamp cabinet thereby forming as an integral entity of the lamp cabinet, wherein the anti-slip ring is easy to grasp, and deters the lamp from slipping when held about the anti-slip ring.

2. The anti-slip fluorescent electronic energy-saving lamp according to claim 1, wherein said anti-slip ring is a colored ring.

3. The anti-slip fluorescent electronic energy-saving lamp according to claim 1, further comprising a lamp shade; said lamp shade having a top, a base on said top, and said base is mounted outside said anti-slip ring on the outer surface of the lamp cabinet.

4. An anti-slip fluorescent electronic energy-saving lamp comprising:

a fluorescent tube;

a lamp cabinet within which the electronic parts are installed, said lamp cabinet having an outer surface, wherein said outer surface has a surface of revolution; said lamp cabinet comprising a top lamp cabinet and a bottom lamp cabinet; and an anti-slip ring, which is ring-shaped and made of a rubber or a plastic, said anti-slip ring being inlaid around the outer surface of said lamp cabinet, and on said top lamp cabinet is provided a groove for receiving said anti-slip ring, one end of said anti-slip ring is protruding inwards and blocked within said groove of said top lamp cabinet, the anti-slip ring thereby formed as an integral entity of the lamp cabinet;

wherein the anti-slip ring is easy to grasp and deters the lamp from slipping when held about the anti-slip ring.

5. The anti-slip fluorescent electronic energy-saving lamp according to claim 4, wherein said anti-slip ring is a colored ring.

6. The anti-slip fluorescent electronic energy-saving lamp according to claim 4, further comprising a lamp shade; said lamp shade having a top, a base on said top, and said base is mounted outside said anti-slip ring on the outer surface of the lamp cabinet.

* * * * *